US006732623B1

(12) United States Patent
Jennings

(10) Patent No.: US 6,732,623 B1
(45) Date of Patent: May 11, 2004

(54) SAFETY PUSH TOOL FOR TABLE MOUNTED CUTTING TOOL HAVING AN ADJUSTABLE HEEL

(76) Inventor: Garman C. Jennings, P.O. Box 1766, Playa Station, Laguna Beach, CA (US) 92652

( * ) Notice: Subject to any disclaimer, the term of this patent is extended or adjusted under 35 U.S.C. 154(b) by 0 days.

(21) Appl. No.: 10/298,019

(22) Filed: Nov. 15, 2002

(51) Int. Cl.[7] ..... B27B 25/10

(52) U.S. Cl. ..... 83/436.2; 83/437.15; 83/437.2; 83/438

(58) Field of Search ..... 83/436.2, 437.2, 83/438, 435.15, 435, 435.11, 425, 440.2, 441.2, 421, 477.2; 144/245.1, 245.6

(56) References Cited

U.S. PATENT DOCUMENTS 4,370,909 A 2/1983 Jennings ..... 83/437
4,485,711 A * 12/1984 Schnell ..... 83/436.2
5,016,509 A * 5/1991 Stottman ..... 83/436.2
5,341,711 A * 8/1994 Stay et al. ..... 83/436.2
5,781,956 A * 7/1998 Kelsay et al. ..... 15/143.1
5,894,777 A * 4/1999 Sterling ..... 83/436.2
6,135,521 A * 10/2000 Wirth et al. ..... 83/436.2

* cited by examiner

*Primary Examiner*—Stephen Choi
(74) *Attorney, Agent, or Firm*—Edgar W. Averill, Jr.

(57) ABSTRACT

A safety push tool for use with table mounted cutting tools. The push tool is of the type having a carrier guide body with an underside adapted to rest on a work piece to be moved along a cutting tool. The safety push tool has a handle portion and the improvement of the present invention is the construction of the back heel member which is held at the slot of the back of the tool. The back heel member is a U-shaped device which fits over a slot over the back of the tool. The back heel member is a U-shaped device which fits over a support arm and can be rotated from a first position where two separate arms depend downwardly from the underside. It also can be moved in a second position where a cross member headstock extends below the underside of the safety push tool.

7 Claims, 2 Drawing Sheets

SAFETY PUSH TOOL FOR TABLE MOUNTED CUTTING TOOL HAVING AN ADJUSTABLE HEEL

BACKGROUND OF THE INVENTION

The field of the invention is hand tools and the invention relates more particularly to a safety push tool with a table mounted saw or other cutting tool. Other cutting tools would include routers, jointers, planers, shapers, and sanders.

Applicant received U.S. Pat. No. 4,370,909 on an early version of the safety push tool of the present invention.

Applicant's earlier tool had a heel portion which could be adjusted up and down by a combination of thumb screws and slots. This heel had a forward portion 32 which abutted the wooden board upon which it rested. The forward portion was a pair of downwardly extending arms which permitted a saw blade to pass between them.

BRIEF SUMMARY OF THE INVENTION

It is an object of the present invention to provide an improved safety push tool which has the ability of reconfiguring the heel thereof so it is capable of pushing a work piece from the corner thereof. Furthermore, it readily can be converted from a first configuration to a second configuration by rotating the heel in a slot formed in the trailing end of the push carrier body.

DESCRIPTION OF THE PREFERRED EMBODIMENTS

Figure 1:
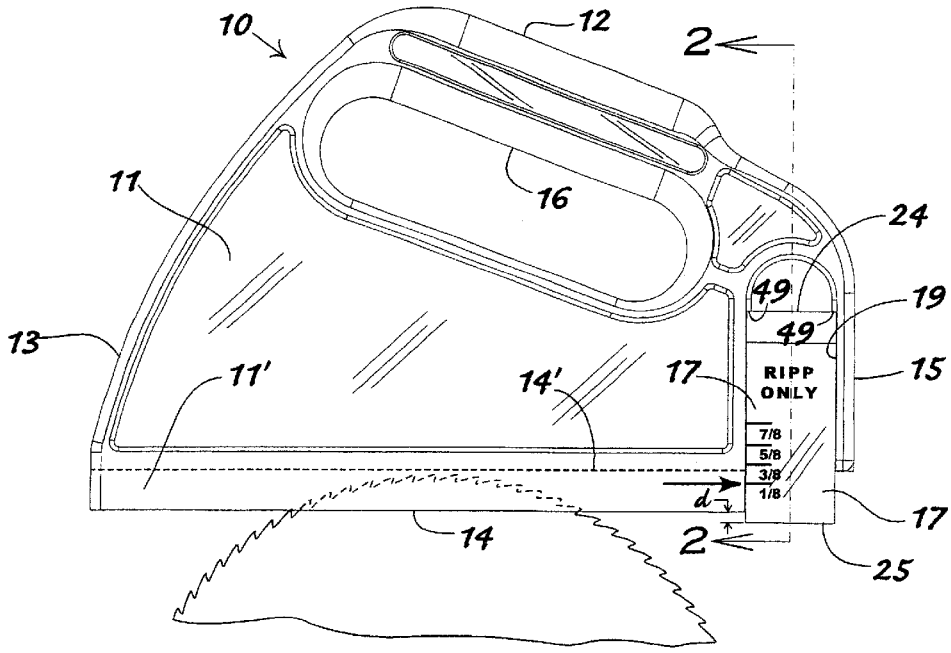
FIG. 1 is a side view of the safety push tool of the present invention.

The safety push tool of the present invention is shown in side view in FIG. 1 and indicated generally by reference character 10. Push tool 10 has a guide body 11 which has a side 11', a top 12, a front edge 13, and underside 14, and a rear edge 15. A handle opening 16 is formed in guide body 11 to assist in guiding the safety push tool. The underside 14 has a recess, the top of which is indicated by reference character 14' in FIG. 1. This permits a saw blade to extend above the underside 14 which includes two laterally spaced apart downwardly extending guides bars which forms the lowermost part of underside 14.

The safety push tool 10 has many features of applicant's device shown in U.S. Pat. No. 4,370,909, which is incorporated by reference herein for purposes of background. The tool in the '909 patent has a heel 30 which is adjustably mounted at the rear of the tool and may be moved up and down to adjust the depth which the heel extends below the underside of the tool.

Figure 3:
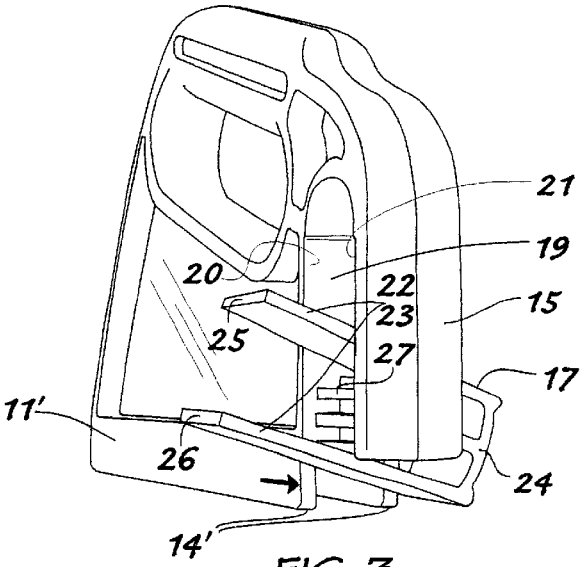
FIG. 3 is a perspective view showing the left side and rear of the push tool of FIG. 1 with the back heel member being shifted from a first position to a second position.
Figure 2:
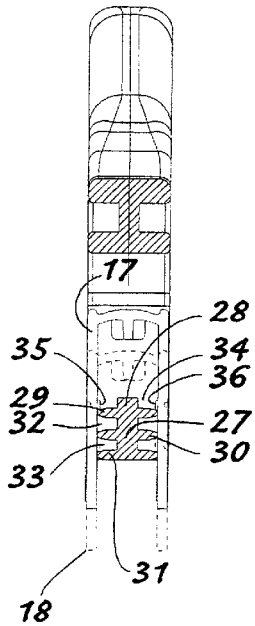
FIG. 2 is a cross-sectional view taken along line 2—2 of FIG. 1.

The tool of the present invention has a back heel assembly indicated generally by reference character 17 and shown in more detail in FIGS. 2 and 3.

As shown in FIG. 3, generally U-shaped back heel member 17 may be rotated in a back heel member support slot 19 which has a forward face 20 and a rearward face 21. The back heel member 17 has two parallel arms 22 and 23 which are held together by a heel headstock 24. Parallel arm 22 has a lower terminus 25 and parallel arm 23 has a lower terminus 26. Back heel member 17 is preferably fabricated from a flexible material, such as polypropylene. This permits the arms 22 and 23 to move in and out as heel member 17 is rotated about back heel member support arm 27.

Back heel support arm 27 is shown in cross-sectional view in FIG. 2 and is integrally formed against interface 20 and rearward face 21. It can, of course, be independently secured by other means.

As shown in FIG. 2, support arm 27 has a vertical central bar 28 from which three horizontal bars 29, 30, and 31 extend. These horizontal bars form notching, locking key points 32 and 33. The space above bar 29 also functions as gap 34, described in more detail below.

As shown in FIG. 2, back heel member 17 may move up and down with respect to back heel member support arm 27. A pair of protrusions 35 and 36 fit adjacent or between horizontal bars 31 and temporarily hold the back heel member 17 in four different temporary positions. The fourth position is where the protrusions 35 and 36 are positioned below horizontal bar 31. This movement of back heel member up and down adjusts the distance "d" that the back heel member extends below underside 14. Indicia are shown in FIG. 1 on the side of the back heel assembly 17 to indicate the dimension of distance "d". The lowered back heel member is indicated in FIG. 2 by phantom line 18.

Figure 4:
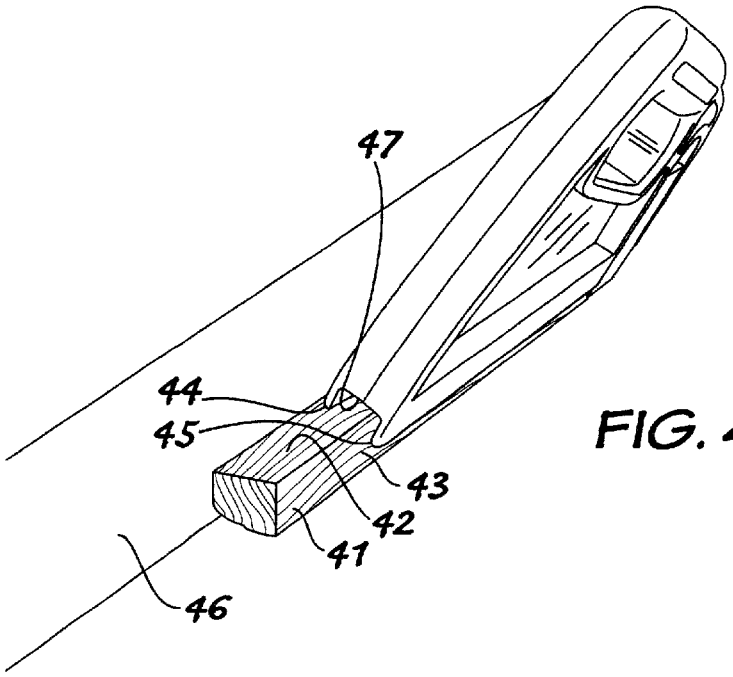
FIG. 4 is a perspective view of the push tool of the present invention being utilized to push a length of molding along a router table.
Figure 5:
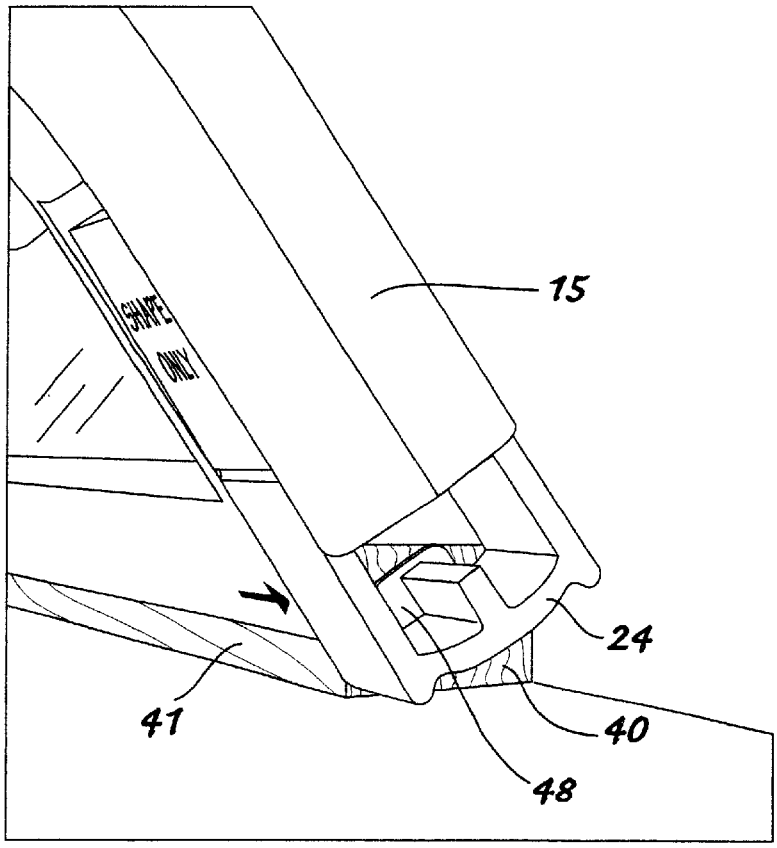
FIG. 5 is a perspective view showing the safety push tool from the heel portion pushing a length of wood through a router-shaper.

As seen most clearly in FIG. 2, the back heel member 17 has an open end and a closed end. As shown in FIGS. 4 and 5, the closed end can be used to push against the corner of a piece to be shaped. For instance, in FIG. 5, the heel headstock 24 contacts end 40 of a length of molding 41. The top of the molding 42 shown in FIG. 4, and the outer side 43, is contacted by the two laterally spaced apart downwardly extending guide bars 44 and 45, which hold the molding 41 against the table mounted guide rail 46. When the back heel member 17 is rotated 180° to the position shown in FIG. 2 of the drawings, the space 47 between the guide bars 44 and 45 extends the entire length of the safety push tool and permits the passage of a saw blade therebetween.

As shown also in FIG. 5, the heel headstock 24 further includes a pusher extension 48, which is held by heel headstock 24, which further enlarges the contact between the heel headstock and the end of the length of molding.

As indicated best in FIG. 1 of the drawings, the back heel member 17 is captured in back heel member support slot 19 which has an upper stop 49. This upper stop contacts either the heel headstock 24 or the terminus 25 and 26 of the back heel member 17. This limits the upward movement of back heel member 17 so that there is always a distance of at least "d" below underside 14. In this manner, the safety push tool always has an area to contact a work piece when placed over the rearward edge of such a work piece.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A safety push tool for use with a table mounted cutting tool, said safety push tool being of the type having a guide body having flat side portions, a front edge, a rear edge, said safety push tool having an underside adapted to rest on a workpiece to be moved along a cutting tool, said safety push tool having a handle portion to assist the user in moving the safety push tool, said underside including two laterally spaced apart, downwardly extending, carrier guide bars, and said underside including a back heel to push against said workpiece, wherein the improvement comprises:

a back heel member support slot formed in said guide body adjacent said rear edge, said support slot having parallel forward and rearward faces and a back heel member support arm held between said forward and rearward faces;

a back heel member held in said back heel member support slot, said back heel member being generally U-shaped having two parallel arms each having a terminus and said two parallel arms being connected by a headstock portion and said two parallel arms surrounding and in contact with said back heel member support arm, said two parallel arms and said headstock portion being flexible so that the two parallel arms are biased against said back heel member support arm and said two parallel arms and said back heel member support arm being shaped to provide at least two stable orientations, one in which the headstock is positioned downwardly and the other when the terminus of said two parallel arms is positioned downwardly, whereby said back heel member may be set in two positions, one where the two parallel arms abut the workpiece and the other when the headstock of the back heel member abuts the workpiece.

2. The safety push tool of claim 1 wherein said two parallel arms of said back heel member each have a pair of inwardly facing protrusions which grasp said back heel member support arm.

3. The safety push tool of claim 2 wherein said back heel member support arm has a vertical central bar with a plurality of horizontal bars extending outwardly therefrom forming at least one gap between two contiguous horizontal bars and said gap on each side of said back heel member support arm and said gap being configured to grasp said inwardly facing protrusions whereby the vertical position of said back heel member can be vertically adjusted.

4. The safety push tool of claim 3 wherein said back heel member support arm has three horizontal bars.

5. The safety push tool of claim 1 wherein said back heel member is fabricated from polypropylene.

6. The safety push tool of claim 1 wherein said headstock portion of said back heel member further includes a pusher extension extending from an inner surface of said headstock portion, said pusher extension having a face which is parallel with a forward edge of said back heel member headstock portion.

7. The safety push tool of claim 1 wherein said back heel member support slot has an upper indentation which contacts said back heel member and said indentation being positioned so that the back heel member can not be retracted to a position where it does not extend below said underside of said safety push tool.

* * * * *